US005873467A

United States Patent [19]

Willhite et al.

[11] Patent Number: 5,873,467

[45] Date of Patent: Feb. 23, 1999

[54] COSMETIC CARRYING CASE

[76] Inventors: Terri Willhite; Joni Johnson, both of HC 60, Box 473, Spavinaw, Okla. 74366

[21] Appl. No.: 80,180

[22] Filed: May 18, 1998

[51] Int. Cl.[6] ..... B65D 69/00

[52] U.S. Cl. ..... 206/581; 206/823; 220/23.87

[58] Field of Search ..... 206/581, 229, 206/823, 557; 220/23.83, 23.86, 23.87, 23.88, 23.89

[56] References Cited

U.S. PATENT DOCUMENTS 4,826,014 5/1989 Schefer ..... 206/581
5,358,100 10/1994 Wolff ..... 206/581

*Primary Examiner*—Jacob K. Ackun

*Attorney, Agent, or Firm*—Douglas E Mackenzie

[57] ABSTRACT

A new cosmetic carrying case having a removable tray for storing various sizes and shapes of cosmetic containers is disclosed. The device includes a bottom portion and a lid, the lid being hingedly attached to the bottom portion, the bottom portion and the lid forming a storage compartment, a first shelf hingedly and latchedly attached to a lid inside portion, a second shelf fixedly disposed within the bottom portion, the second shelf having an opening formed therein, and a removable tray having a plurality of container receiving apertures formed therein, the removable tray being removably receivable within the opening. The first shelf further includes a pair of spaced apart straps for securing a nail dryer. The second shelf includes a plurality of compartments and a plurality of apertures designed for receiving cosmetic vessels.

9 Claims, 2 Drawing Sheets

COSMETIC CARRYING CASE

BACKGROUND OF THE INVENTION

1. Field of the Invention

The present invention relates to cosmetic cases and more particularly pertains to a new cosmetic carrying case having a removable tray for storing various sizes and shapes of cosmetic containers.

2. Description of the Prior Art

The use of cosmetic cases is known in the prior art. More specifically, cosmetic cases heretofore devised and utilized are known to consist basically of familiar, expected and obvious structural configurations, notwithstanding the myriad of designs encompassed by the crowded prior art which have been developed for the fulfillment of countless objectives and requirements.

Known prior art cosmetic cases include U.S. Pat. No. 5,211,302; U.S. Pat. No. 4,936,463; U.S. Pat. No. Des. 354,622; U.S. Pat. No. 4,821,751; U.S. Pat. No. Des. 303, 874 and U.S. Pat. No. 5,375,734.

While these devices fulfill their respective, particular objectives and requirements, the aforementioned patents do not disclose a new cosmetic carrying case. The inventive device includes a bottom portion and a lid, the lid being hingedly attached to the bottom portion, the bottom portion and the lid forming a storage compartment, a first shelf hingedly and latchedly attached to a lid inside portion, a second shelf fixedly disposed within the bottom portion, the second shelf having an opening formed therein, and a removable tray having a plurality of container receiving apertures formed therein, the removable tray being removably receivable within the opening.

In these respects, the cosmetic carrying case according to the present invention substantially departs from the conventional concepts and designs of the prior art, and in so doing provides an apparatus primarily developed for the purpose of having a removable tray for storing various sizes and shapes of cosmetic containers.

SUMMARY OF THE INVENTION

In view of the foregoing disadvantages inherent in the known types of cosmetic cases now present in the prior art, the present invention provides a new cosmetic carrying case construction wherein the same has a removable tray for storing various sizes and shapes of cosmetic containers.

The general purpose of the present invention, which will be described subsequently in greater detail, is to provide a new cosmetic carrying case apparatus and method which has many of the advantages of the cosmetic cases mentioned heretofore and many novel features that result in a new cosmetic carrying case which is not anticipated, rendered obvious, suggested, or even implied by any of the prior art cosmetic cases, either alone or in any combination thereof.

To attain this, the present invention generally comprises a bottom portion and a lid, the lid being hingedly attached to the bottom portion, the bottom portion and the lid forming a storage compartment, a first shelf hingedly and latchedly attached to a lid inside portion, a second shelf fixedly disposed within the bottom portion, the second shelf having an opening formed therein, and a removable tray having a plurality of container receiving apertures formed therein, the removable tray being removably receivable within the opening.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cosmetic carrying case apparatus and method which has many of the advantages of the cosmetic cases mentioned heretofore and many novel features that result in a new cosmetic carrying case which is not anticipated, rendered obvious, suggested, or even implied by any of the prior art cosmetic cases, either alone or in any combination thereof.

It is another object of the present invention to provide a new cosmetic carrying case which may be easily and efficiently manufactured and marketed.

It is a further object of the present invention to provide a new cosmetic carrying case which is of a durable and reliable construction.

An even further object of the present invention is to provide a new cosmetic carrying case which is susceptible of a low cost of manufacture with regard to both materials and labor, and which accordingly is then susceptible of low prices of sale to the consuming public, thereby making such cosmetic carrying case economically available to the buying public.

Still yet another object of the present invention is to provide a new cosmetic carrying case which provides in the apparatuses and methods of the prior art some of the advantages thereof, while simultaneously overcoming some of the disadvantages normally associated therewith.

Still another object of the present invention is to provide a new cosmetic carrying case having a removable tray for storing various sizes and shapes of cosmetic containers.

Yet another object of the present invention is to provide a new cosmetic carrying case which includes a bottom portion and a lid, the lid being hingedly attached to the bottom portion, the bottom portion and the lid forming a storage compartment, a first shelf hingedly and latchedly attached to a lid inside portion, a second shelf fixedly disposed within the bottom portion, the second shelf having an opening formed therein, and a removable tray having a plurality of container receiving apertures formed therein, the removable tray being removably receivable within the opening.

Still yet another object of the present invention is to provide a new cosmetic carrying case that provides a means for the person using the cosmetic carrying case to use a removable tray suited to the style and make of the nail polish containers being used by the person.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
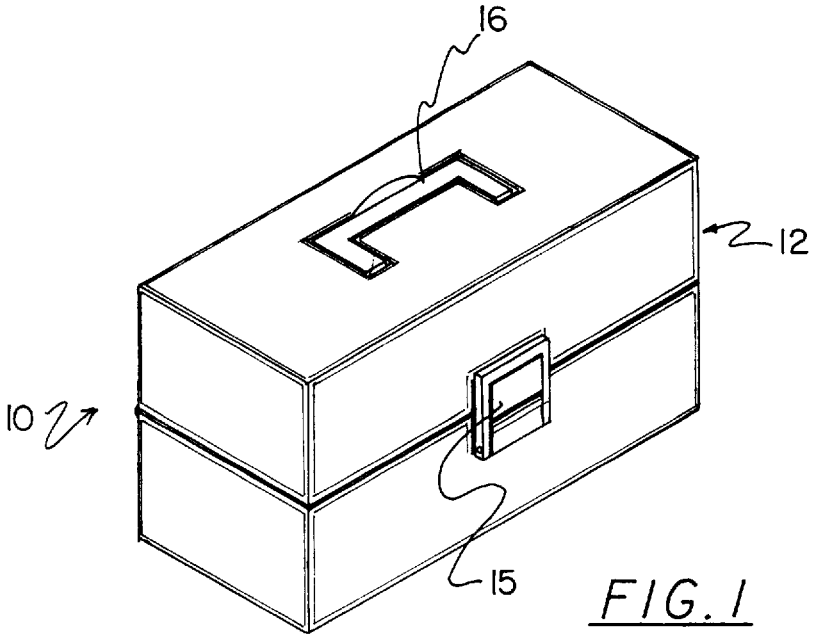
FIG. 1 is a left side perspective view of a new cosmetic carrying case according to the present invention.

With reference now to the drawings, and in particular to FIGS. 1 through 4 thereof, a new cosmetic carrying case embodying the principles and concepts of the present invention and generally designated by the reference numeral 10 will be described.

More specifically, it will be noted that the cosmetic carrying case 10 comprises a bottom portion 14 and a lid 13 hingedly attached to the bottom portion 14. The bottom portion 14 and the lid 13 are shown forming a storage compartment 12 within which are stored for carrying various cosmetic products.

With reference to FIG. 1, a latch 15 is shown for securing the bottom portion 14 to the lid 13. A handle 16 is also shown hingedly attached to a top portion of the lid 13 to facilitate the carrying of the cosmetic carrying case 10.

Figure 2:
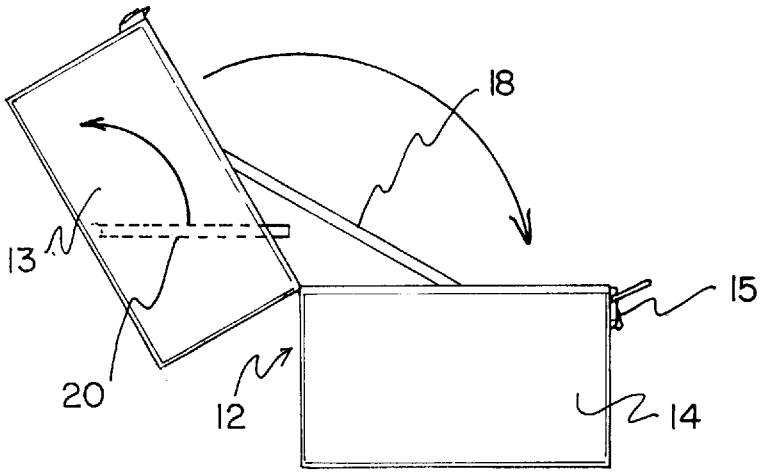
FIG. 2 is a side elevation view thereof showing the cosmetic carrying case in its open position.
Figure 3:
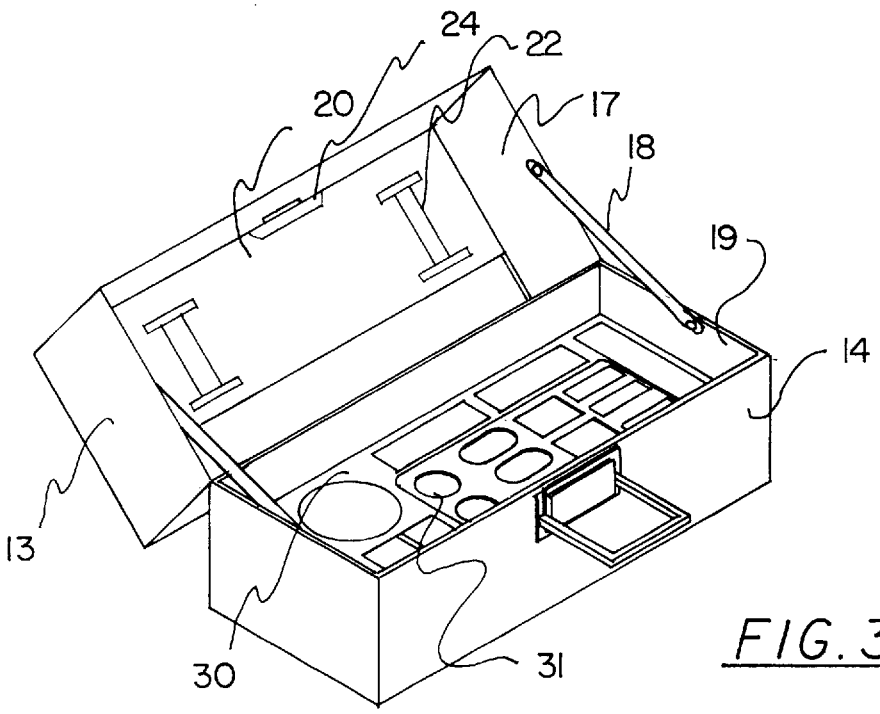
FIG. 3 is left perspective view of the cosmetic carrying case in its open position.

With reference to FIGS. 2 and 3, a first shelf 20 is shown hingedly attached to an inside portion 17 of the lid 13. A latch 24 is also shown for securing the first shelf 20 when not in use. A means for securing a nail dryer is shown disposed on a bottom side of the first shelf 20 and includes a pair of parallel and spaced apart straps 22 fixedly attached to the bottom side of the first shelf 20.

With continued reference to FIGS. 2 and 3, a pair of retaining straps 18 are shown. Each retaining strap 18 is secured at one end thereof to the lid inside portion 17 and at the other end thereof to a bottom portion inside portion 19. The straps 18 serve to limit the motion to of the lid 13 relative to the bottom portion 14 so that the first shelf 20 lays in a horizontal plane when the cosmetic carrying case 10 is in its open position and the first shelf 20 is being used.

Figure 4:
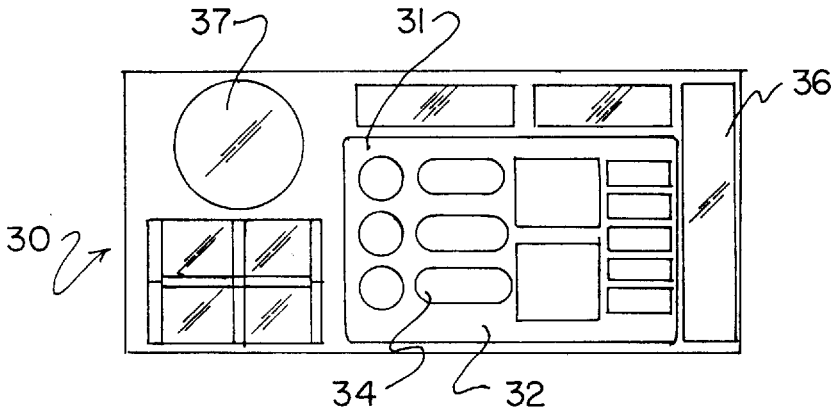
FIG. 4 is a plan view of the removable tray of the present invention.

With reference to FIGS. 3 and 4, a second shelf 30 is shown fixedly disposed within the bottom portion inside portion 19. The second shelf 30 includes a plurality of compartments 36 for receiving items such as press on nails, cuticle scissors, emery boards, files and orange sticks. The second shelf 30 also is shown including a plurality of apertures 34 formed therethrough, the apertures being configured to receive cosmetic vessels such as nail polish remover containers, base coat, top coat, nail dry and fix a nail.

A removable tray 32 is shown disposed in an opening 31 formed in the second shelf 30. The removable tray 32 includes a plurality of container receiving apertures 34 formed therein. The container receiving apertures 34 are shaped and configured to receive nail polish containers of various sizes and makes, as for example, the nail polish containers sold by MaxFactor, Maybeline and Revlon. The removable tray 32 is preferably injection molded and the container receiving apertures 34 formed to closely receive the nail polish containers. A plurality of removable trays 32 are provided to enable the person using the cosmetic carrying case 10 to securely carry the particular nail polish they are currently using.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cosmetic carrying case comprising:

a bottom portion and a lid, the lid being hingedly attached to the bottom portion, the bottom portion and the lid forming a storage compartment;

a first shelf hingedly and latchedly attached to a lid inside portion;

a second shelf fixedly disposed within the bottom portion, the second shelf having an opening formed therein; and a plurality of removable trays having a plurality of container receiving apertures formed therein, the container receiving apertures being for receiving nail polish containers, each removable tray being singly and removably receivable within the opening.

2. The cosmetic carrying case of claim 1, wherein the second shelf further comprises a plurality of storage compartments formed therein.

3. The cosmetic carrying case of claim 1, wherein the first shelf further comprises a means for securing a nail dryer disposed on a bottom side thereof.

4. The cosmetic carrying case of claim 3, wherein the means for securing the nail dryer further comprise a pair of parallel and spaced apart straps fixedly attached to a first shelf bottom side.

5. The cosmetic carrying case of claim 1 further comprising a latch, the latch securing the lid to the bottom portion.

6. The cosmetic carrying case of claim 1, wherein the lid further comprises a handle hingedly attached to a top portion thereof.

7. The cosmetic carrying case of claim 1 further comprising a pair of retaining straps secured at one end thereof to the lid inside portion and at the other end thereof to a bottom portion inside portion, the straps limiting the extent of motion of the lid relative to the bottom portion.

8. The cosmetic carrying case of claim 1, wherein the second shelf further comprises a plurality of apertures formed therethrough, the apertures being configured to receive cosmetic vessels.

9. A cosmetic carrying case comprising:

a bottom portion and a lid, the lid being hingedly attached to the bottom portion and having a handle hingedly attached to a top portion thereof, the bottom portion and the lid forming a storage compartment;

a first shelf hingedly and latchedly attached to a lid inside portion, the first shelf further having a pair of parallel and spaced apart straps fixedly attached to a bottom side thereof, the pair of parallel and spaced apart straps being for securing a nail dryer;

a second shelf fixedly disposed within the bottom portion, the second shelf having a plurality of storage compartments formed therein, a plurality of apertures formed therethrough, the apertures being configured to receive cosmetic vessels, and an opening formed therein for removably receiving one of a plurality of removable trays having a plurality of container receiving apertures formed therein, the container receiving apertures being for receiving nail polish containers;

a latch for securing the lid to the bottom portion; and a pair of retaining straps secured at one end thereof to the lid inside portion and at the other end thereof to a bottom portion inside portion, the straps limiting the extent of motion of the lid relative to the bottom portion.

* * * * *